United States Patent [19]

Kalina

[11] Patent Number: 4,604,867

[45] Date of Patent: Aug. 12, 1986

[54] METHOD AND APPARATUS FOR IMPLEMENTING A THERMODYNAMIC CYCLE WITH INTERCOOLING

[76] Inventor: Alexander I. Kalina, 12214 Clear Fork, Houston, Tex. 77077

[21] Appl. No.: 705,906

[22] Filed: Feb. 26, 1985

[51] Int. Cl.[4] ..... F01K 7/38; F01K 25/00

[52] U.S. Cl. ..... 60/653; 60/670; 60/649

[58] Field of Search ..... 60/653, 670, 677, 678, 60/679, 649, 673

[56] References Cited

U.S. PATENT DOCUMENTS 3,979,914 9/1976 Weber ..... 60/678

4,433,545 2/1984 Chang ..... 60/677

*Primary Examiner*—Allen M. Ostrager

*Attorney, Agent, or Firm*—Arnold, White & Durkee

[57] ABSTRACT

A method and apparatus for implementing a thermodynamic cycle with intercooling, includes a condensing subsystem, a boiler, and a turbine. The boiler may include a preheater, an evaporator, and a superheater. After initial expansion in the turbine, the fluid may be diverted to a reheater to increase the temperature available for superheating. After return to the turbine and additional expansion, the fluid may be withdrawn from the turbine and cooled in an intercooler. Thereafter the fluid is returned to the turbine for additional expansion. The cooling of the turbine gas may provide additional heat for evaporation. Intercooling may provide compensation for the heat used in reheating and may provide recuperation of available heat which would otherwise remain unused following final turbine expansion.

30 Claims, 4 Drawing Figures

TEMPERATURE (DEG. F)
HEAT DUTY (BTU/hr)
A
B
B1
B2
B3

TEMPERATURE (DEG. F)
HEAT DUTY (BTU/hr)
A
C
25
30,41
53
40
54
48
49
SV
55
SL
44,46
26
22

METHOD AND APPARATUS FOR IMPLEMENTING A THERMODYNAMIC CYCLE WITH INTERCOOLING

BACKGROUND OF THE INVENTION

1. Field of the Invention

This invention relates generally to methods and apparatus for transforming energy from a heat source into usable form using a working fluid that is expanded and regenerated. This invention further relates to a method and apparatus for improving the heat utilization efficiency of a thermodynamic cycle.

2. Brief Description of the Background Art

In the Rankine cycle, a working fluid such as water, ammonia or a freon is evaporated in an evaporator utilizing an available heat source. The evaporated gaseous working fluid is expanded across a turbine to transform its energy into usable form. The spent gaseous working fluid is then condensed in a condenser using an available cooling medium. The pressure of the condensed working medium is increased by pumping, followed by evaporation and so on to continue the cycle.

The Exergy cycle, described in U.S. Pat. No. 4,346,561, utilizes a binary or multi-component working fluid. This cycle operates generally on the principle that a binary working fluid is pumped as a liquid to a high working pressure and is heated to partially vaporize the working fluid. The fluid is then flashed to separate high and low boiling working fluids. The low boiling component is expanded through a turbine, to drive the turbine, while the high boiling component has heat recovered for use in heating the binary working fluid prior to evaporation. The high boiling component is then mixed with the spent low boiling working fluid to absorb the spent working fluid in a condenser in the presence of a cooking medium.

The theoretical comparison of the conventional Rankine cycle and the Exergy cycle demonstrates the improved efficiency of the new cycle over the Rankine cycle when an available, relatively low temperature heat source such as ocean water, geothermal energy or the like is employed.

In applicant's further invention, referred to as the Basic Kalina cycle, the subject of U.S. Pat. No. 4,489,563, relatively lower temperature available heat is utilized to effect partial distillation of at least a portion of a multi-component fluid stream at an intermediate pressure to generate working fluid fractions of differing compositions. The fractions are used to produce at least one main rich solution which is relatively enriched with respect to the lower boiling component, and to produce one lean solution which is relatively impoverished with respect to the lower boiling component. The pressure of the main rich solution is increased; thereafter, it is evaporated to produce a charged gaseous main working fluid. The main working fluid is expanded to a low pressure level to convert energy to usable form. The spent low pressure level working fluid is condensed in a main absorption stage by dissolving with cooling in the lean solution to regenerate an initial working fluid for reuse.

In any process of converting thermal energy to a usable form, the major loss of available energy in the heat source occurs in the process of boiling or evaporating the working fluid. This loss of available energy (known as exergy or essergy) is due to the mismatch of the enthalpy-temperature characteristics of the heat source and the working fluid in the boiler. Simply put, for any given enthalpy the temperature of the heat source is always greater than the temperature of the working fluid. Ideally, this temperature difference would be almost, but not quite, zero.

This mismatch occurs both in the classical Rankine cycle, using a pure substance as a working fluid, as well as in the Kalina and Exergy cycles described above, using a mixture as the working fluid. The use of a mixture as a working fluid in the manner of the Kalina and Exergy cycles reduces these losses to a significant extent. However, it would be highly desirable to further reduce these losses in any cycle.

In the conventional Rankine cycle, the losses arising from mismatching of the enthalpy-temperature characteristics of the heat source and the working fluid would constitute about 25% of the available exergy. With a cycle such as that described in U.S. Pat. No. 4,489,563, the loss of exergy in the boiler due to enthalpy-temperature characteristics mismatching would constitute about 14% of all of the available exergy.

The overall boiling process in a thermodynamic cycle can be viewed for discussion purposes as consisting of three distinct parts: preheating, evaporation, and superheating. With conventional technology, the matching of a heat source and the working fluid is reasonably adequate during preheating. However, the quantity of heat in the temperature range suitable for superheating is generally much greater than necessary, while the quantity of heat in the temperature range suitable for evaporation is much smaller than necessary. The inventor of the present invention has appreciated that a portion of the high temperature heat which would be suitable for high temperature superheating is used for evaporation in previously known processes. This causes very large temperature differences between the two streams, and as a result, irreversible losses of exergy.

These irreversible losses may be lessened by reheating the stream of working fluid after it has been partially expanded in a turbine. However, reheating results in repeated superheating. As a result, reheating increases the necessary quantity of heat for superheating. This increase in the required heat provides better matching between the heat source and the working fluid enthalpy-temperature characteristics. However, reheating has no beneficial effect with respect to the quantity of heat necessary for evaporation. Thus, the total quantity of heat necessary per unit of weight of working fluid significantly increases with reheating. Therefore, the total weight flow rate of working fluid through the boiler turbine is reduced. Thus, the benefits of reheating are largely transitory in that the reduced weight flow rate limits the possible increase in overall efficiency that may be derived.

The ideal solution to the age old dilemma of poorly matched heat source and working fluid enthalpy-temperature characteristics would be one that makes high temperature heat available from the heat source for use in superheating thereby reducing the temperature differences during superheating, but at the same time provides lower temperature heat which minimizes the temperature differences in the process of evaporation. It should be evident that these two goals are apparently mutually inconsistent since increasing the superheating heat would appear to require either increasing the overall heating source temperature or using reheating. As discussed above, reheating has certain drawbacks, which to a large degree mitigate the partly transitory gains achieved.

Moreover, the greater the available heat for superheating, the greater would be the output temperature of the gaseous spent working fluid from the turbine. This is undesirable from an efficiency standpoint since the superheating of the exiting steam makes subsequent condensing more difficult and causes additional losses of exergy. Thus, any effort to improve efficiency with respect to one part of the cycle seems to eventually cause lower efficiency in another part of the cycle.

SUMMARY OF THE INVENTION

It is one feature of the present invention to provide a significant improvement in the efficiency of a thermodynamic cycle by permitting closer matching of the working fluid and the heat source enthalpy-temperature characteristics in the boiler. It is also a feature of the present invention to provide a system which both increases the efficiency of superheating while providing concommitant advantages during evaporation. Another feature of the present invention is to enable these advantages to be attained without necessarily adversely reducing the mass flow rate of the cycle.

In accordance with one embodiment of the present invention, a method of implementing a thermodynamic cycle includes the step of expanding a gaseous working fluid to transform its energy into a usable form. The expanded gaseous working fluid is cooled and subsequently expanded to a spent low pressure level to transform its energy into a usable form. The spent working fluid is condensed. The condensed fluid is then evaporated using the heat transferred during the cooling of the expanded gaseous working fluid.

In accordance with another embodiment of the present invention, a method of implementing a thermodynamic cycle includes the step of superheating an evaporated working fluid. The superheated fluid is expanded to transform its energy into usable form. The expanded fluid is then reheated and subsequently further expanded to transform additional energy into a usable form. The expanded, reheated fluid is cooled and again expanded, this time to a spent low pressure level to transform its energy into a usable form. The spent working fluid is condensed and subsequently evaporated using heat transferred during cooling from the expanded, reheated fluid.

In accordance with yet another embodiment of the present invention, a method for implementing a thermodynamic cycle includes the step of preheating an initial working fluid to a temperature approaching its boiling temperature. The preheated initial working fluid is split into first and second fluid streams. The first fluid stream is evaporated using a first heat source while a second fluid stream is evaporated using a second heat source. The first and second evaporated fluid streams are combined and subsequently superheated to produce a charged gaseous main working fluid. The charged gaseous main working fluid is expanded to transform its energy into a usable form. Then the expanded, charged main working fluid is reheated and again expanded. The expanded, reheated, charged main working fluid is cooled to provide the heat source for evaporating the second fluid stream. The cooled main working fluid is again expanded, this time to a spent low pressure level to transform its energy into a usable form. The spent main working fluid is cooled and condensed to form the intial working fluid.

In accordance with still another embodiment of the present invention, an apparatus for implementing a thermodynamic cycle includes a turbine device. The turbine device has first and second turbine sets each including at least one turbine stage. Each of the turbine sets has a gas inlet and a gas outlet. A turbine gas cooler is connected between the gas outlet of the first set and the gas inlet of the second set, such that most of the fluid passing through the turbine would pass through the turbine gas cooler and then back to said turbine device.

DESCRIPTION OF A PREFERRED EMBODIMENT

Figure 1:
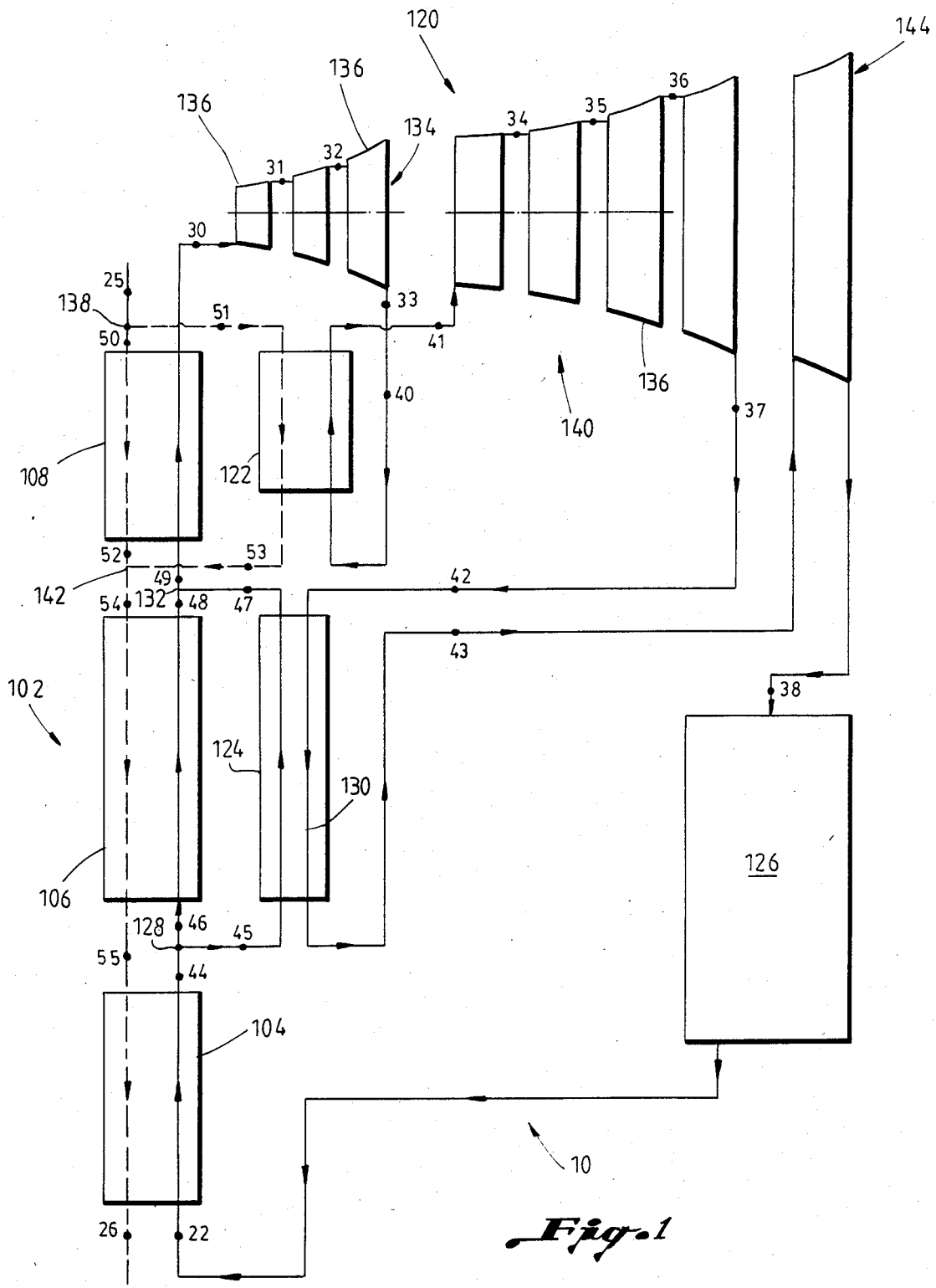
FIG. 1 is a schematic representation of one system for carrying out one embodiment of the method and apparatus of the present invention.

Referring to the drawing wherein like reference characters are utilized for like parts throughout the several views, a system 10, shown in FIG. 1, implements a thermodynamic cycle, in accordance with one embodiment of the present invention. The system 10 includes a boiler 102, in turn made up of a preheater 104, an evaporator 106, and a superheater 108. In addition, the system 10 includes a turbine 120, a reheater 122, an intercooler 124, and a condensing subsystem 126.

The condenser 126 may be any type of known heat rejection device. In the Rankine cycle, heat rejection occurs in a simple heat exchanger and thus, for Rankine applications, the condensing subsystem 126 may take the form of a heat exchanger or condenser. In the Kalina cycle, described in U.S. Pat. No. 4,489,563 to Kalina, the heat rejection system requires that gases leaving the turbine be mixed with a multi-component fluid stream, for example, comprised of water and ammonia, condensed and then distilled to produce the original state of the working fluid. Thus, when the present invention is used with a Kalina cycle, the distillation subsystem described in U.S. Pat. No. 4,489,563 may be utilized as the condensing subsystem 126. U.S. Pat. No. 4,489,563 is hereby expressly incorporated by reference herein.

Various types of heat sources may be used to drive the cycle of this invention. Thus, for example, heat sources with temperatures as high as, say 1000° C. or more, down to low heat sources such as those obtained from ocean thermal gradients may be utilized. Heat sources such as, for example, low grade primary fuel, waste heat, geothermal heat, solar heat or ocean thermal energy conversion systems may be implemented with the present invention.

A variety of working fluids may be used in conjunction with this system depending on the kind of condensing subsystem 126 utilized. In conjunction with a condensing subsystem 126 as described in the U.S. patent incorporated by reference herein, any multi-component working fluid that comprises a lower boiling point fluid and a relatively higher boiling point fluid may be utilized. Thus, for example, the working fluid employed may be an ammonia-water mixture, two or more hydrocarbons, two or more freons, mixtures of hydrocarbons and freons or the like. In general, the fluid may be mixtures of any number of compounds with favorable thermodynamic characteristics and solubility. However, when implementing the conventional Rankine cycle, a conventional single component working fluid such as water, ammonia, or freon may be utilized.

As shown in FIG. 1, a completely condensed working fluid passes through a preheater 104 where it is heated to a temperature a few degrees below its boiling temperature. This preheating is provided by the cooling of all streams of a heat source indicated in dashed lines through the preheater 104. The working fluid which exits the preheater 104 is divided at point 128 into two separate streams.

A first stream, separated at point 128, enters the evaporator 106 while the second stream enters the intercooler 124. The first stream is heated in the evaporator 106 by the countercurrent heating fluid flow indicated in dashed lines through the evaporator 106 and communicating with the heating fluid flow through the preheater 104. The second fluid stream passing through the intercooler 124 is heated by the fluid flow proceeding along line 130. Both the first and second streams are completely evaporated and initially superheated. Each of the streams has approximately the same pressure and temperature but the streams may have different flow rates. The fluid streams from the evaporator 106 and intercooler 124 are then recombined at point 132.

Figure 4:
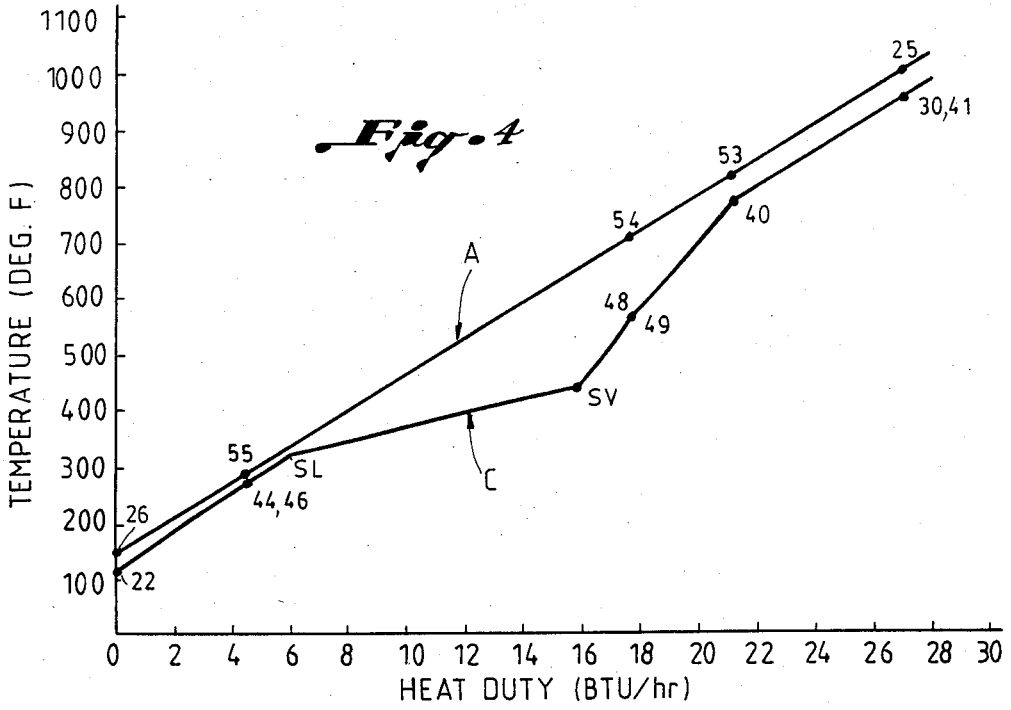
FIG. 4 is a graph of calculated temperature in degrees Fahrenheit versus boiler heat duty or enthalpy in BTU's per hour in accordance with one exemplary embodiment of the present invention.

The combined stream of working fluid is sent into the superheater 108 where it is finally superheated by heat exchange with only part of the heat source stream indicated by dashed lines extending through the superheater 108. Thus, the heat source stream extending from point 25 to point 26 passes first through the superheater 108, then through the evaporator 106 and finally through the preheater 104. The enthalpy-temperature characteristics of the illustrated heating fluid stream, indicated by the line A in FIG. 4, is linear.

From the superheater 108, the total stream of working fluid enters the first turbine set 134 of turbine 120. The turbine set 134 includes one or more stages 136 and, in the illustrated embodiment, the first turbine set 134 includes three stages 136. In the first turbine set 134 the working fluid expands to a first intermediate pressure thereby converting thermal energy into mechanical energy.

The whole working fluid stream from the first turbine set 134 is reheated in the reheater 122. The reheater 122 is a conventional superheater or heat exchanger. With this reheating process the remaining portion of the heat source stream, split at point 138 from the flow from point 25 to point 26, is utilized. Having been reheated to a high temperature, the stream of working fluid leaves the reheater 122 and travels to the second turbine set 140. At the same time the heating fluid flow from point 51 to point 53 is returned to the main heating fluid flow at point 142 to contribute to the processes in the evaporator 106 and preheater 104. The second turbine set 140 may include a number of stages 136. In the illustrated embodiment, the second turbine set 140 is shown as having four stages, however, the number of stages in each of the turbine sets described herein may be varied widely depending on particular circumstances.

The working fluid in the second turbine set 140 is expanded from the first intermediate pressure to a second intermediate pressure, thus generating power. The total stream of working fluid is then sent to the intercooler 124 where it is cooled, providing the heat necessary for the evaporation of the second working fluid stream. The intercooler 124 may be a simple heat exchanger. The fluid stream travels along the line 130 to the last turbine set 144.

The last turbine set 144 is illustrated as having only a single stage 136. However, the number of stages in the last turbine set 144 may be subject to considerable variation depending on specific circumstances. The working fluid expands to the final spent fluid pressure level thus producing additional power. From the last turbine set 144 the fluid stream is passed through the condensing subsystem 126 where it is condensed, pumped to a higher pressure and sent to the preheater 104 to continue the cycle.

Figure 2:
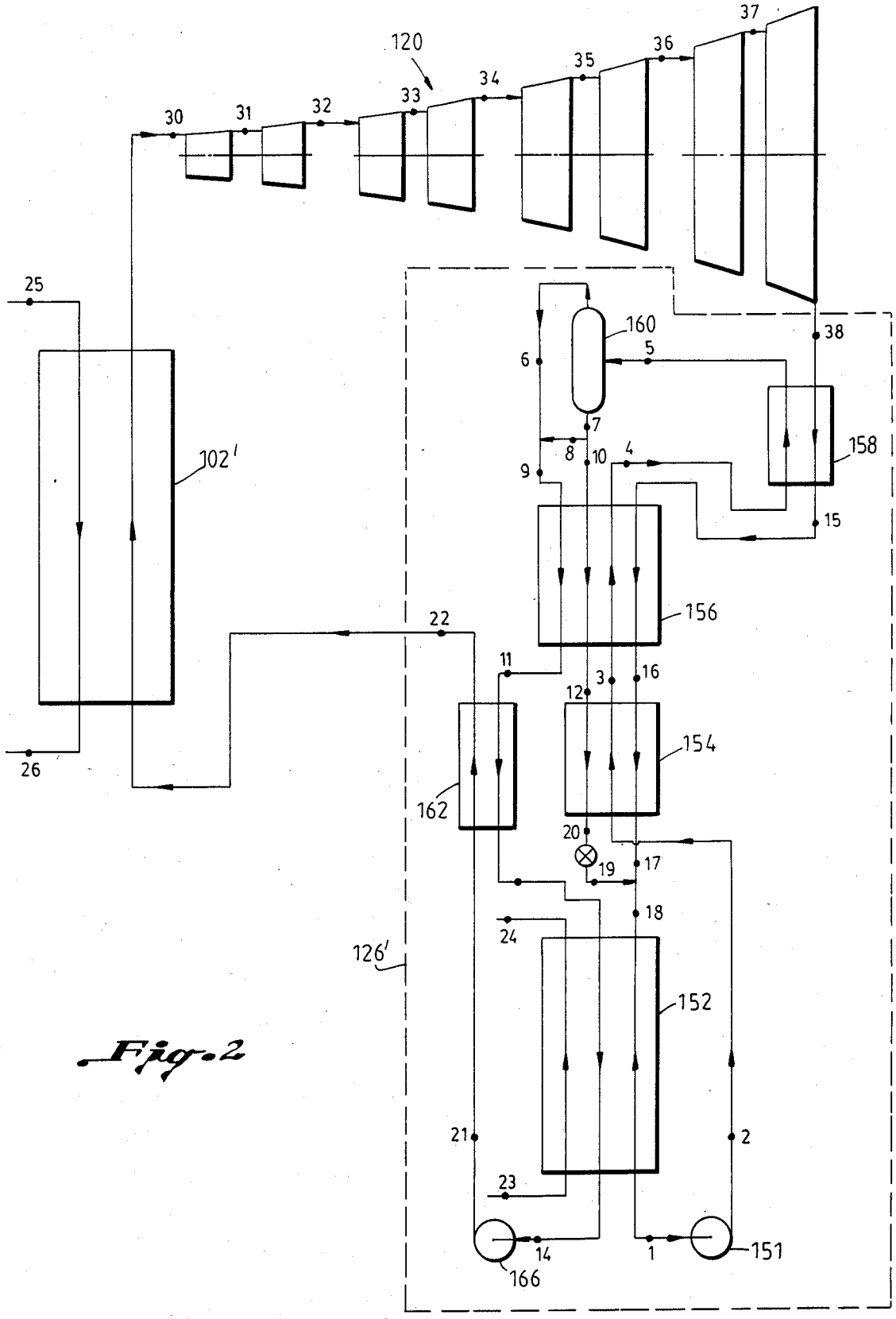
FIG. 2 is a schematic representation of one exemplary embodiment of Applicant's previous invention, showing within dashed lines a schematic representation of one exemplary condensing subsystem for use in the system shown in FIG. 1.

A Kalina cycle condensing subsystem 126', shown in FIG. 2, may be used as the condensing subsystem 126 in the system shown in FIG. 1. In analyzing the condensing subsystem 126', it is useful to commence with the point in the subsystem identified by reference numeral 1 comprising the initial composite stream having an initial composition of higher and lower boiling components in the form of ammonia and water. At point 1 the initial composite stream is at a spent low pressure level. It is pumped by means of a pump 151 to an intermediate pressure level where its pressure parameters will be as at point 2 following the pump 151.

From point 2 of the flow line, the initial composite stream at an intermediate pressure is heated consecutively in the heat exchanger 154, in the recuperator 156 and in the main heat exchanger 158.

The initial composite stream is heated in the heat exchanger 154, in the recuperator 156 and in the main heat exchanger 158 by heat exchange with the spent composite working fluid from the turbine 120'. When the system of FIG. 1 is being implemented with the condensing subsystem 126' the turbine 120 may be used in place of the turbine 120'. In addition, in the heat exchanger 154 the initial composite stream is heated by the condensation stream as will be hereinafter described. In the recuperator 156 the initial composite stream is further heated by the condensation stream and by heat exchange with lean and rich working fluid fractions as will be hereinafter described.

The heating in the main heat exchanger 158 is performed only by the heat of the flow from the turbine outlet and, as such, is essentially compensation for under recuperation.

At point 5 between the main heat exchanger 158 and the separator stage 160 the initial composite stream has been subjected to distillation at the intermediate pressure in the distillation system comprising the heat exchangers 154 and 158 and the recuperator 156. If desired, auxiliary heating means from any suitable or available heat source may be employed in any one of the heat exchangers 154 or 158 or in the recuperator 156.

At point 5 the initial composite stream has been partially evaporated in the distillation system and is sent to the gravity separator stage 160. In this stage 160 the enriched vapor faction which has been generated in the distillation system, and which is enriched with the low boiling component, namely ammonia, is separated from the remainder of the initial composite stream to produce an enriched vapor fraction at point 6 and a stripped liquid fraction at point 7 from which the enriched vapor fraction has been stripped.

Further, the stripped liquid fraction from point 7 is divided into first and second stripped liquid fraction streams having parameters as at points 8 and 10 respectively.

The enriched fraction at point 6 is enriched with the lower boiling component, namely ammonia, relatively to a lean working fluid fraction as discussed below.

The first enriched vapor fraction stream from point 6 is mixed with the first stripped liquid fraction stream at point 8 to provide a rich working fluid fraction at point 9.

The rich working fluid fraction is enriched relatively to the composite working fluid (as hereinafter discussed) with the lower boiling component comprising ammonia. The lean working fluid fraction, on the other hand, is impoverished relatively to the composite working fluid (as hereinafter discussed) with respect to the lower boiling component.

The second stripped liquid fraction at point 10 comprises the remaining part of the initial composite stream and is used to constitute the condensation stream.

The rich working fluid fraction at point 9 is partially condensed in the recuperator 156 to point 11. Thereafter the rich working fluid fraction is further cooled and condensed in the preheater 162 (from point 11 to 13), and is finally condensed in the absorption stage 152 by means of heat exchange with a cooling water supply through points 23 to 24.

The rich working fluid fraction is pumped to a charged high pressure level by means of the pump 166. Thereafter it passes through the preheater 162 to arrive at point 22. From point 22 it may continue through the system shown in FIG. 1.

When a Kalina cycle is implemented, the composite working fluid at point 38 exiting from the turbine 120 has such a low pressure that it cannot be condensed at this pressure and at the available ambient temperature. From point 38 the spent composite working fluid flows through the main heat exchanger 158, through the recuperator 156 and through the heat exchanger 154. Here it is partially condensed and the released heat is used to preheat the incoming flow as previously discussed.

The spent composite working fluid at point 17 is then mixed with the condensation stream at point 19. At point 19 the condensation stream has been throttled from point 20 to reduce its presure to the low presure level of the spent composite working fluid at point 17. The resultant mixture is then fed from point 18 through the absorption stage 152 where the spent composite working fluid is absorbed in the condensation stream to regenerate the initial composite stream at point 1.

The intercooling process accomplished by the intercooler 124, shown in FIG. 1, reduces the output of the last turbine stage per pound of working fluid. However, intercooling also enables reheating without sacrificing the quantity of working fluid per pound. Thus, compared to reheating without intercooling, the use of intercooling achieves significant advantages.

The heat returned by the intercooler 124 to the evaporation process is advantageously approximately equal the heat consumed in the reheater 122. This assures that the weight flow rate of the working fluid is restored. Then it is not necessary to decrease the mass flow rate of the working fluid to accommodate the higher temperature reheating process.

The parameters of flow at points 40, 41, 42 and 43 are design variables and can be chosen in a way to obtain the maximum advantage from the system 10. One skilled in the art will be able to select the design variables to maximize performance under the various circumstances that may be encountered.

The parameters of the various process points, shown in FIG. 1, are subject to considerable variation depending on specific circumstances. However, as a general guide or rule of thumb to the design of systems of this type, it can be pointed out that it may often be advantageous to make the temperature at point 40 as close as possible to the temperature of point 37 so that the efficiencies of the first turbine set 134 and the second turbine set 140 are close to equal. In addition, it may be desirable in many situations to design the system so that the temperature at point 42 is generally higher than the temperature of the saturated vapor of the working fluid in the evaporator 106. It may also often be desirable to make the temperature at point 43 generally higher than the temperature of a saturated liquid of the working fluid in the boiler 102.

While a single pressure in the evaporator 106 and intercooler 124 is utilized in the illustrated embodiment, one skillled in the art will appreciate that dual, triple and even higher numbers of boiler pressures may be selected for specific circumstances. The present invention is also applicable to multiple boiling cycles. While special advantages may be achieved through the use of intercooler 124 heat in the evaporation process, the use of the intercooler 124 between turbine sets can be applied to any portion of a thermodynamic system where there is a shortage of adequate temperature heat. Intercooling could provide heat to supplement boiling or to supplement heating in a superheater.

It should be understood that the present invention is not limited to the use of intercooling in combination with reheating. Although this combination results in significant advantages, many advantages can be achieved with intercooling without reheating. For example, intercooling may be utilized without reheating whenever the fluid exiting from the final turbine stage is superheated. In general, it is important that intercooling be taken between turbine stages in order to obtain a sufficiently high fluid temperature.

It is generally advantageous that at least most of the fluid flow through the turbine be passed through the intercooler. Even more advantageously, substantially all of the flow through the turbine is passed through the intercooler. Advantageously, substantially all of the cooled fluid is returned to the turbine for further expansion.

Figure 3:
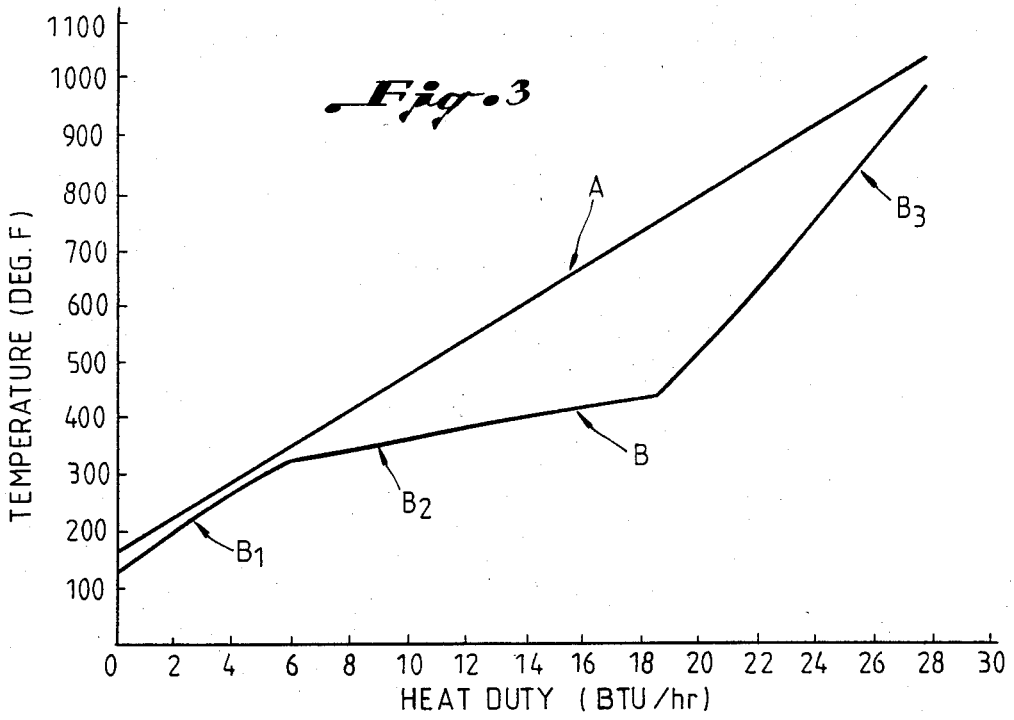
FIG. 3 is a graph of calculated temperature in degrees Fahrenheit versus boiler heat duty or enthalpy in BTU's per hour for the exemplary embodiment of Applicant's previous invention shown in FIG. 2.

The advantages of the present invention may be appreciated by comparison of FIGS. 3 and 4. In FIG. 3 a boiler heat duty cycle for a thermodynamic cycle is illustrated for a system of the type shown in FIG. 2, pursuant to the teachings of U.S. Pat. No. 4,489,563, previously incorporated herein. The heat source is indicated by the line A while the working fluid is indicated by the line B. The enthalpy-temperature characteristics of the working fluid during preheating are represented by the curve portion B1. Similarly, evaporation is indicated by the portion B2 and superheating is indicated by the portion B3. The pinch point is located in the region of the intersection of the portions B1 and B2. The extent of the gap between the curves A and B represents irreversible inefficiencies in the system which are sought to be minimized by the present invention. During superheating, excessive heat is available, while during evaporation insufficient heat is available.

Referring now to FIG. 4, calculated temperature versus enthalpy or heat duty in a boiler is shown for an illustrative embodiment of the present invention. The working fluid is represented by curve C while the heat source fluid is represented by the curve A. The points on the graph correspond to points on FIG. 1. Instead of having three approximately linear regions, the graph shows that the working fluid has approximately four linear regions with the present invention. In the region between points 22 and 44, 46, preheating is occuring in the manner generally identical to that occuring with Applicant's previous invention, represented by portion B1 in FIG. 3. Evaporation is represented by the curve portion between the points 44, 46 and 48, 49 and the saturated liquid point is indicated as "SL" while the saturated vapor point is indicated as "SV". The curve portion between points 48, 49 and 30, 41 represents superheating with reheating following efficient evaporation. It can be seen that the curve portion between points 40 and 30, 41 closely follows the heat source line A and therefore results in close temperature matching. In general, the overall configuration of the curve, particularly, the portion between points SV and 30, 41 more closely approximates the heat source line A than was previously possible so that greater efficiencies may be realized with the present invention.

In order to further illustrate the advantages that can be obtained by the present invention, two sets of calculations were performed. In both sets, the same heat source was utilized. The first set of calculations is related to an illustrative power cycle in accordance with the system shown in FIG. 2. In this illustrative cycle the working fluid is a water-ammonia mixture with a concentration of 72.5 weight percent of ammonia (weight of ammonia to total weight). The parameters for the theoretical calculations which were performed utilizing standard ammonia-water enthalpy/concentration diagrams are set forth in Table 1 below. In this table the points set forth in the first column correspond to points set forth in FIG. 2.

TABLE 1

| Point No. | Temp. (°F.) | Press. (psia) | Enthalpy (BTU/lb) | $NH_4$ Concentration lbs $NH_4$/total wt. | W lb/hr |
|---|---|---|---|---|---|
| 1 | 60.00 | 23.40 | −79.72 | .4392 | 104639.19 |
| 2-17 | 60.00 | 74.61 | −79.72 | .4392 | 52073.66 |
| 2-20 | 60.00 | 74.61 | −79.72 | .4392 | 52565.53 |
| 2 | 60.00 | 74.61 | −79.72 | .4392 | 104639.19 |
| 3-17 | 115.87 | 74.31 | −16.82 | .4392 | 52073.66 |
| 3-20 | 115.87 | 74.31 | −16.82 | .4392 | 52565.53 |
| 3 | 115.87 | 74.31 | −16.82 | .4392 | 104639.19 |
| 3-11 | 115.87 | 74.31 | −16.82 | .4392 | 26111.02 |
| 3-12 | 115.87 | 74.31 | −16.82 | .4392 | 37736.67 |
| 3-16 | 115.87 | 74.31 | −16.82 | .4392 | 40791.51 |
| 4-11 | 134.02 | 74.11 | 45.97 | .4392 | 26111.02 |
| 4-12 | 134.02 | 74.11 | 45.97 | .4392 | 37736.67 |
| 4-16 | 134.02 | 74.11 | 45.97 | .4392 | 40791.51 |
| 4 | 134.02 | 74.11 | 45.97 | .4392 | 104639.19 |
| 5 | 148.23 | 73.91 | 104.42 | .4392 | 104639.19 |
| 6 | 148.23 | 73.91 | 625.12 | .9688 | 13821.00 |
| 7 | 148.23 | 73.91 | 25.19 | .3586 | 90818.19 |
| 8 | 148.23 | 73.91 | 25.19 | .3586 | 9197.34 |
| 9 | 148.23 | 73.91 | 385.41 | .7250 | 23018.34 |
| 10 | 148.23 | 73.91 | 25.19 | .3586 | 81620.85 |
| 11 | 123.01 | 73.71 | 314.18 | .7250 | 23018.34 |
| 12 | 122.52 | 73.91 | −3.84 | .3586 | 81620.85 |
| 13 | 101.31 | 73.61 | 245.97 | .7250 | 23018.34 |

TABLE 1-continued

| Point No. | Temp. (°F.) | Press. (psia) | Enthalpy (BTU/lb) | $NH_4$ Concentration lbs $NH_4$/total wt. | W lb/hr |
|---|---|---|---|---|---|
| 14 | 60.00 | 73.51 | −48.36 | .7250 | 23018.34 |
| 15 | 148.23 | 23.90 | 548.21 | .7250 | 23018.34 |
| 16 | 122.01 | 23.70 | 436.94 | .7250 | 23018.34 |
| 17 | 75.00 | 23.60 | 294.63 | .7250 | 23018.34 |
| 18 | 84.37 | 23.60 | 30.22 | .4392 | 104639.19 |
| 19 | 86.01 | 23.60 | −44.35 | .3586 | 81620.85 |
| 20 | 86.71 | 73.91 | −44.35 | .3586 | 81620.85 |
| 21 | 60.00 | 1574.00 | −48.36 | .7250 | 23018.34 |
| 22 | 119.01 | 1573.00 | 19.85 | .7250 | 23018.34 |
| 23-14 | 55.00 | — | — | WATER | 741492.81 |
| 23-1 | 55.00 | — | — | WATER | 485596.48 |
| 23 | 55.00 | — | — | WATER | 1227089.29 |
| 24-13 | 64.14 | — | — | WATER | 741492.81 |
| 24-18 | 78.69 | — | — | WATER | 485596.48 |
| 24 | 69.90 | — | — | WATER | 1227089.29 |
| 25 | 1040.00 | — | 235.95 | GAS | 125248.00 |
| 26 | 152.82 | — | 13.26 | GAS | 125248.00 |
| 30 | 990.00 | 1570.00 | 1231.52 | .7250 | 23018.34 |
| 31 | 918.46 | 1090.00 | 1187.99 | .7250 | 23018.34 |
| 32 | 841.93 | 734.00 | 1141.40 | .7250 | 23018.34 |
| 33 | 756.84 | 470.00 | 1090.03 | .7250 | 23018.34 |
| 34 | 664.37 | 288.00 | 1035.14 | .7250 | 23018.34 |
| 35 | 565.61 | 168.00 | 978.08 | .7250 | 23018.34 |
| 36 | 453.43 | 87.00 | 915.46 | .7250 | 23018.34 |
| 37 | 367.12 | 50.00 | 868.77 | .7250 | 23018.34 |
| 38 | 262.47 | 24.10 | 813.91 | .7250 | 23018.34 |

The above cycle had an output of 2595.78 KWe with a cycle efficiency of 31.78%.

In the second case study, an illustrative power cycle in accordance with the present invention was added to the apparatus which was the subject of the aforementioned case study. The same pressure in the boiler, the same composition of working fluid, and the same temperature of cooling water were employed. The parameters for the theoretical calculations which were performed again utilizing standard ammonia-water and enthalpy/concentration diagrams are set out in Table 2 below. In Table 2 below, points 1–21 correspond with the specifically marked points in FIG. 2. Points 23–55 correspond with the specifically marked points in FIG. 1 herein.

In relation to this second case study, the following data was calculated:

TABLE 2

| Point No. | Temp. (°F.) | Press. (psia) | Enthalpy (BTU/lb) | $NH_4$ Concentration lbs $NH_4$/total wt. | W lb/hr |
|---|---|---|---|---|---|
| 1 | 60.00 | 25.60 | −79.85 | .4536 | 105580.76 |
| 2-17 | 60.00 | 74.61 | −79.85 | .4536 | 50589.80 |
| 2-20 | 60.00 | 74.61 | −79.85 | .4536 | 54990.97 |
| 2 | 60.00 | 74.61 | −79.85 | .4536 | 105580.76 |
| 3-17 | 111.28 | 74.31 | −22.07 | .4536 | 50589.80 |
| 3-20 | 111.28 | 74.31 | −22.07 | .4536 | 54990.97 |
| 3 | 111.28 | 74.31 | −22.07 | .4536 | 105580.76 |
| 3-11 | 111.28 | 74.31 | −22.07 | .4536 | 28091.82 |
| 3-12 | 111.28 | 74.31 | −22.07 | .4536 | 40205.78 |
| 3-16 | 111.28 | 74.31 | −22.07 | .4536 | 37283.16 |
| 4-11 | 127.49 | 74.11 | 33.90 | .4536 | 28091.82 |
| 4-12 | 127.49 | 74.11 | 33.90 | .4536 | 40205.78 |
| 4-16 | 127.49 | 74.11 | 33.90 | .4536 | 37283.16 |
| 4 | 127.49 | 74.11 | 33.90 | .4536 | 105580.76 |
| 5 | 142.00 | 73.91 | 93.93 | .4536 | 105580.76 |
| 6 | 142.00 | 73.91 | 618.89 | .9741 | 13639.05 |
| 7 | 142.00 | 73.91 | 16.07 | .3764 | 91941.71 |
| 8 | 142.00 | 73.91 | 16.07 | .3764 | 9745.95 |
| 9 | 142.00 | 73.91 | 367.65 | .7250 | 23385.00 |
| 10 | 142.00 | 73.91 | 16.07 | .3764 | 82195.76 |
| 11 | 118.33 | 73.71 | 300.43 | .7250 | 23385.00 |
| 12 | 117.83 | 73.91 | −11.31 | .3764 | 82195.76 |

TABLE 2-continued

| Point No. | Temp. (°F.) | Press. (psia) | Enthalpy (BTU/lb) | $NH_4$ Concentration lbs $NH_4$/ total wt. | W lb/hr |
|---|---|---|---|---|---|
| 13 | 99.03 | 73.61 | 237.69 | .7250 | 23385.00 |
| 14 | 60.00 | 73.51 | −48.36 | .7250 | 23385.00 |
| 15 | 142.00 | 26.10 | 500.68 | .7250 | 23385.00 |
| 16 | 117.49 | 25.90 | 411.45 | .7250 | 23385.00 |
| 17 | 75.00 | 25.80 | 286.44 | .7250 | 23385.00 |
| 18 | 82.86 | 25.80 | 24.54 | 0.4536 | 105,580.76 |
| 19 | 83.66 | 25.80 | −49.97 | 0.3764 | 82,195.76 |
| 20 | 83.66 | 73.91 | −49.97 | 0.3764 | 82,195.76 |
| 21 | 60.00 | 75.40 | −48.36 | 0.7250 | 23,385.00 |
| 22 | 114.33 | 1,574.40 | 14.38 | 0.7250 | 23,385.00 |
| 23-14 | 55.00 | — | — | WATER | — |
| 23-1 | 55.00 | — | — | WATER | — |
| 23 | 55.00 | — | — | WATER | — |
| 24-13 | 63.88 | — | — | WATER | — |
| 24-18 | 76.79 | — | — | WATER | — |
| 24 | 69.07 | — | — | WATER | — |
| 25 | 1,040.00 | — | 235.95 | GAS | 125,248.00 |
| 26 | 147.30 | — | 11.85 | — | 125,248.00 |
| 30 | 990.00 | 1,570.00 | 1,231.518 | 0.725 | 23,385.00 |
| 31 | 925.50 | 1,140.00 | 1,192.105 | 0.725 | 23,385.00 |
| 32 | 848.91 | 768.00 | 1,145.497 | 0.725 | 23,385.00 |
| 33 | 769.84 | 510.00 | 1,097.707 | 0.725 | 23,385.00 |
| 34 | 896.96 | 330.00 | 1,182.850 | 0.725 | 23,385.00 |
| 35 | 803.24 | 210.00 | 1,123.792 | 0.725 | 23,385.00 |
| 36 | 708.98 | 130.00 | 1,065.948 | 0.725 | 23,385.00 |
| 37 | 602.31 | 72.40 | 1,002.486 | 0.725 | 23,385.00 |
| 38 | 181.56 | 26.30 | 771.740 | 0.725 | 23,385.00 |
| 40 | 769.84 | 510.00 | 1,097.707 | 0.725 | 23,385.00 |
| 41 | 990.00 | 509.00 | 1,243.062 | 0.725 | 23,385.00 |
| 42 | 602.31 | 72.40 | 1,002.486 | 0.725 | 23,385.00 |
| 43 | 318.15 | 71.40 | 840.260 | 0.725 | 23,385.00 |
| 44 | 293.55 | 1,570.00 | 233.915 | 0.725 | 23,385.00 |
| 45 | 293.55 | 1,570.00 | 233.915 | 0.725 | 5,448.71 |
| 46 | 293.55 | 1,570.00 | 233.915 | 0.725 | 17,936.30 |
| 47 | 562.00 | 1,570.00 | 930.164 | 0.725 | 5,448.71 |
| 48 | 562.00 | 1,570.00 | 930.164 | 0.725 | 17,936.30 |
| 49 | 562.00 | 1,570.00 | 930.164 | 0.725 | 23,385.00 |
| 50 | 1,040.00 | — | 235.950 | GAS | — |
| 51 | 1,040.00 | — | 235.950 | GAS | — |
| 52 | 618.65 | — | 130.184 | GAS | — |
| 53 | 809.00 | — | 177.962 | GAS | — |
| 54 | 707.73 | — | 152.545 | GAS | — |
| 55 | 310.50 | — | 52.838 | GAS | — |

This cycle would have an output of 2,800.96 kWe with a cycle efficiency of 34.59%. Thus, the improvement ratio is 1.079. The additional power gained is 204 kWe (7.9%). The weight flow rate is increased 1.386% and the exergy losses are reduced by 6.514%.

Thus, with the combination of the intermediate reheating between stages of the turbine and intercooling between stages of the turbine, high temperature heat is available from the heat source for use in superheating with reduced temperature differences. In its turn, the deficit of heat caused by such double superheating is compensated for by the heat released in the process of recooling, but at a significantly lower temperature, resulting in lower temperature differences in the process of evaporation.

As a result, the exergy losses in the boiler as a whole are drastically reduced. The efficiency of the whole cycle is proportionately increased.

While the addition of the present invention to Applicant's previous cycle results in significant improvements, the increase in output is much higher when the present invention is added to a conventional Rankine cycle apparatus. This is due to the fact that the cycle described in the above-mentioned patent is much more efficient than the Rankine cycle and consequently leaves less room for further improvement.

In order to illustrate the advantages that can be obtained by the present invention used in the Rankine cycle, two sets of calculations were performed. These calculations are based on the utilization of the same heat source as described above with the same cooling-water temperature and the same constraints. A Rankine cycle, using pure water as a working fluid with a single pressure in the boiler equal to 711.165 psia, has a calculated total net output of 1,800 kWe, with a cycle efficiency of 22.04%. When this Rankine cycle system is modified to include reheating and intercooling, the modified cycle achieves a calculated output of 2,207 kWe, with a cycle efficiency of 27.02%. Thus, the improvement ratio is 1.226, and the additional power gained is 407 kWe.

While the present invention has been described with respect to a single preferred embodiment, those skilled in the art will appreciate a number of variations and modifications therefrom and it is intended within the appended claims to cover all such variations and modifications as fall within the true spirit and scope of the present invention.

What is claimed is:

1. A method for implementing a thermodynamic cycle comprising the steps of:

expanding a gaseous working fluid to transform its energy into usable form;

cooling said expanded gaseous working fluid;

expanding said cooled working fluid to a spent low pressure level to transform its energy into usable form;

condensing said spen working fluid; and evaporating said condensed working fluid using heat transferred during cooling from said expanded gaseous working fluid.

2. The method of claim 1 wherein said evaporating step includes the steps of dividing said condensed working fluid into two distinct fluid streams, evaporating the first of said fluid streams in an evaporator and evaporating the second of said fluid streams in the presence of the expanded gaseous working fluid so as to cool said expanded gaseous working fluid and to evaporate said second fluid stream.

3. The method of claim 2 including the step of preheating said condensed working fluid before dividing said condensed working fluid into two separate streams.

4. The method of claim 1 including the step of expanding said working fluid to a spent low pressure level at which said fluid is a saturated liquid.

5. The method of claim 1 wherein said working fluid is a single component working fluid.

6. The method of claim 1 wherein said working fluid includes at least two components having different boiling points.

7. The method of claim 3 including the steps of reheating said working fluid after expanding said gaseous working fluid and expanding said working fluid again after reheating but before said cooling step.

8. The method of claim 7 including the steps of providing a flow of heating fluid, said heating fluid providing the heat for preheating said working fluid and heating said first stream, using a portion of said heating fluid for superheating said evaporated condensed working fluid and using another portion of said heating fluid for reheating said gaseous working fluid.

9. The method of claim 8 including the step of recombining said portion of said heating fluid used for reheating with the remainder of said heating fluid before said heating fluid is used for evaporating said condensed working fluid.

10. The method of claim 1 wherein said cooling step includes the step of cooling substantially all of the gaseous working fluid and thereafter expanding substantially all of said cooled working fluid.

11. A method for implementing a thermodynamic cycle comprising the steps of:

superheating an evaporated working fluid;

expanding said superheated fluid to transform its energy into a usable form;

reheating said expanded fluid;

expanding said reheated fluid to transform its energy into a usable form;

cooling said expanded, reheated fluid;

expanding said cooled fluid to a spent low pressure level to transform its energy to a usable form;

condensing said spent working fluid; and evaporating said condensed working fluid using heat transfered from said expanded, reheated fluid during cooling.

12. The method of claim 11 including the step of providing a fluid medium which acts as a heat source for superheating and evaporating said working fluid.

13. The method of claim 12 including the steps of using a portion of said fluid heat source for reheating said expanded fluid, using another portion of said fluid heat source for superheating said evaporated working fluid, and recombining said two fluid streams for evaporating said condensed fluid.

14. The method of claim 11 including the step of preheating said condensed working fluid.

15. The method of claim 14 including the steps of splitting said preheated fluid into two fluid streams, one of said fluid streams being evaporated in a first evaporator and the other of said fluid streams being evaporated by said heat transfer during cooling from said expanded, reheated fluid, and recombining said fluid streams before superheating the working fluid.

16. The method of claim 15 wherein said cooling step includes the step of cooling most of said expanded reheated fluid.

17. The method of claim 15 wherein said cooling step includes the step of cooling substantially all of said expanded reheated fluid and then expanding substantially all of said cooled fluid.

18. The method of claim 11 including the step of making the temperature of the expanded fluid to be reheated approximately equal to the temperature of the expanded fluid to be cooled.

19. The method of claim 11 including the step of making the temperature of the fluid before cooling generally higher than the temperature of a saturated vapor of the working fluid being evaporated.

20. The method of claim 11 including the step of making the temperature of the cooled fluid higher than the temperature of the saturated liquid of the working fluid being evaporated.

21. The method of claim 11 including the step of making the heat returned to the system by cooling approximately equal the heat consumed by reheating.

22. The method of claim 11 wherein said working fluid is a multi-component fluid stream.

23. A method for implementing a thermodynamic cycle comprising the steps of:

preheating an initial working fluid to a temperature approaching its boiling temperature;

splitting the preheated initial working fluid into first and second fluid streams;

evaporating said first stream using a first heat source;

evaporating said second stream using a second heat source:

recombining said first and second evaporated streams;

superheating said recombined working fluid to produce a charged gaseous main working fluid;

expanding the charged main working fluid to transform its energy into a usable form;

reheating said expanded, charged main working fluid;

expanding the reheated main working fluid to transform its energy into a usable form;

cooling substantially all of said expanded, reheated charged main working fluid to provide said heat source for evaporating said second fluid stream;

expanding the cooled main working fluid to a spent low pressure level to transform its energy into a usable form; and cooling said condensed, spent main working fluid to form said initial working fluid.

24. An apparatus for implementing a thermodynamic cycle comprising:

a turbine device having first and second turbine sets, each set including at least one turbine stage, each of said sets having a vapor inlet and a vapor outlet, said first turbine set including first and second turbine sections, each of said sections including at least one turbine stage and having a vapor inlet and a vapor outlet;

a turbine vapor reheater connected between the vapor outlet of said first turbine section and the vapor inlet of said second turbine section; and a turbine vapor cooler connected between the vapor outlet of of the first set and vapor inlet of the said second set, such that most of the fluid passing through the turbine device would pass through the turbine vapor cooler and back to said turbine device.

25. The apparatus of claim 24 including a condensation subsystem connected to the outlet of said second turbine set, and a boiler connected between the inlet to said first turbine set and the outlet of said condensation subsystem, said boiler including a preheating portion, an evaporating portion and a superheating portion.

26. The apparatus of claim 25 wherein said preheating portion is fluidically connected to said evaporator and said turbine vapor cooler so that fluid flow from said preheating portion may be evaporated in said turbine vapor cooler and said evaporating portion.

27. The apparatus of claim 26 wherein said boiler is connectable to a fluid heat source, said reheater including means for diverting said heat source through said reheater so as to bypass said superheater and means for returning said portion of said heat source to the fluid flow before entry into said evaporating portion.

28. The apparatus of claim 25 wherein said condensing subsystem is a distilling device for condensing multicomponent working fluids.

29. The apparatus of claim 24 wherein said vapor cooler is arranged to receive substantially all of the flow through said turbine and to return said flow to said turbine device.

30. An apparatus for implementing a thermodynamic cycle comprising:

a turbine device having first and second turbine sets, each set including at least one turbine stage, each of said sets having a vapor inlet and a vapor outlet; and a turbine vapor cooler connected between the vapor outlet of said first set and the vapor inlet of said second set, such that substantially all of the fluid passing through the turbine device would pass through the turbine vapor cooler and back to said turbine device.

* * * * *